US006537189B1

(12) United States Patent
Gehle

(10) Patent No.: US 6,537,189 B1
(45) Date of Patent: Mar. 25, 2003

(54) DEVICE FOR STAMPING GROOVE LINES ON CORRUGATED BOARD

(76) Inventor: Harald Gehle, Im Wiesengrund 5, D-22889 Tangsedt (DE)

( * ) Notice: Subject to any disclaimer, the term of this patent is extended or adjusted under 35 U.S.C. 154(b) by 0 days.

(21) Appl. No.: 09/701,691

(22) PCT Filed: Oct. 13, 1999

(86) PCT No.: PCT/EP99/07712

§ 371 (c)(1),
(2), (4) Date: Nov. 30, 2000

(87) PCT Pub. No.: WO00/21741

PCT Pub. Date: Apr. 20, 2000

(30) Foreign Application Priority Data

Oct. 15, 1998 (DE) ..... 198 49 282

(51) Int. Cl.[7] ..... B31B 1/25; B31F 1/08
(52) U.S. Cl. ..... 493/396; 493/58; 493/402
(58) Field of Search ..... 493/59–61, 58, 493/396–398, 402–403; 83/886, 676

(56) References Cited

U.S. PATENT DOCUMENTS 3,314,339 A * 4/1967 Guffy et al. ..... 493/403
4,406,648 A 9/1983 Cavagna et al. ..... 493/403
4,715,847 A * 12/1987 Focke et al. ..... 493/11
4,741,729 A * 5/1988 Edwards ..... 294/87.2
5,873,807 A * 2/1999 Lauderbaugh et al. ..... 493/403

FOREIGN PATENT DOCUMENTS

DE 1511020 6/1969
DE 3617916 A1 12/1987
DE 19538512 4/1997

* cited by examiner

*Primary Examiner*—John Sipos
*Assistant Examiner*—Hemant M. Desai
(74) *Attorney, Agent, or Firm*—Medlen & Carroll LLP

(57) ABSTRACT

The invention relates to a device for stamping groove lines on corrugated board to better fold and comply with the sizes of boxes in production and processing machines having a combined grooving and transport, body (1) and a counter-body. The combined grooving and transport body (1) is fitted on its periphery with a grooving ring (11) having straight individual surfaces, said ring having the shape of a regular polygon with straight flat pieces whose number varies due to the different peripheries.

17 Claims, 1 Drawing Sheet

DEVICE FOR STAMPING GROOVE LINES ON CORRUGATED BOARD

FIELD OF THE INVENTION

The present invention relates to the field of corrugated cardboard production; more particularly, the present invention relates to devices for scoring corrugated cardboard.

BACKGROUND OF THE INVENTION

In the corrugated cardboard industry, grooving or scoring is produced automatically in the longitudinal direction of the machine by means of scoring blades or rings. This scoring, which provides grooves or creases which determine where the cardboard blank is to be folded subsequently, is especially critical and produces uncontrolled gap widths in the finished folded box according to the state of the art today. This is solely the result of unsatisfactory scoring.

Scoring is performed in the longitudinal direction of the corrugated cardboard and thus longitudinally to the corrugations in the cardboard, therefore always encountering different conditions from the peaks to the valleys of the corrugations. Since the cardboard is folded over belts, a phenomenon called fish-tailing occurs when the folding runs slightly towards the rear in the case when the embossing of the corrugations is less than 100%.

The embossing of the corrugations is also influenced by the grade of paper used. Lightweight paper and recycled grades of paper cannot be embossed to the full extent because these types of paper easily develop cracks and thus reduce the loading capacity of the folded boxes.

German Patent 31 38 454 C2 discloses a device and a method for scoring corrugated cardboard for creating folding grooves for folding and maintaining the dimensions of the cardboard for use with corrugated cardboard scoring machines, where the corrugated cardboard or the cardboard which is to be provided with grooves is passed between two rolls and is thereby scored. The distance between the two rolls is adjusted in advance according to the thickness of the cardboard to be scored, so that the correct pressure is applied to the material to be scored.

German Patent 36 17 916 A1 discloses a method and a device for producing corrugated cardboard blanks for folded boxes, where the blank is conveyed through a feed station, stamping station, a cooling station, a punching station and a discharge station in succession with the help of a conveyor device. Such a machine is known as an in-line machine, because several operations are carried out in one machine. The stamping station of this device has a hydraulically or mechanically driven stamping press with a stationary base plate and a vertically movable upper pressure plate for applying bent edges to predetermined positions on the blank sheets under local effective pressure. Both plates have heating plates whose temperature can be adjusted independently of the other. Since the heating plates are mounted on the stamping die, the scoring is always accompanied by heating and thus is a stationary process. The machine must operate intermittently, i.e., the conveyor device must first pass a blank sheet beneath the stamping die, then stop to close the stamping die and remain closed until the heating plates have been adequately heated. Then the stamping force is increased to stamp the scoring lines. Then the stamping die opens and the conveyor device starts up again, conveying the blank sheet thus scored to the cooling station. One disadvantage of this known device and the method that can be carried out with it is that the conveyor device must be repeatedly braked and then must start up again, which necessitates frequent braking and deceleration of substantial weights and causes a high power consumption. This also naturally limits the speed of the process.

Finally, German Patent Application 195 38 512 A1 describes a method and a device for creating scored lines in corrugated cardboard for better folding and to maintain the correct box dimensions for in-line machines. Immediately before scoring or during the scoring itself, the part of the corrugated cardboard being scored is heated with the help of a heatable table.

In the case of all the known methods, the scoring is performed as a rotational process and is usually performed in the longitudinal direction of the corrugations in the cardboard, so the scoring point begins at different points in the corrugations. This causes great problems in the so-called gap tolerance, which is very important in automatic packaging because it determines the accuracy in folding the box.

SUMMARY OF THE INVENTION

The object of the present invention is to provide a device with which more accurate scoring of corrugated cardboard can be achieved than in the related art for the subsequent production of folded boxes. A device having the features of the independent patent claims are used to achieve this object. Advantageous embodiments of the present invention are derived from the dependent claims.

Although the corrugated cardboard is conveyed with a rotating ring in the present invention, the actual scoring is created by a varying number of straight lines or sides, the exact number of sides depending on the outside diameter of the ring.

BRIEF DESCRIPTION OF THE DRAWINGS

The present invention is explained in greater detail below on the basis of the drawings in which.

DETAILED DESCRIPTION OF THE INVENTION

Figure 1:
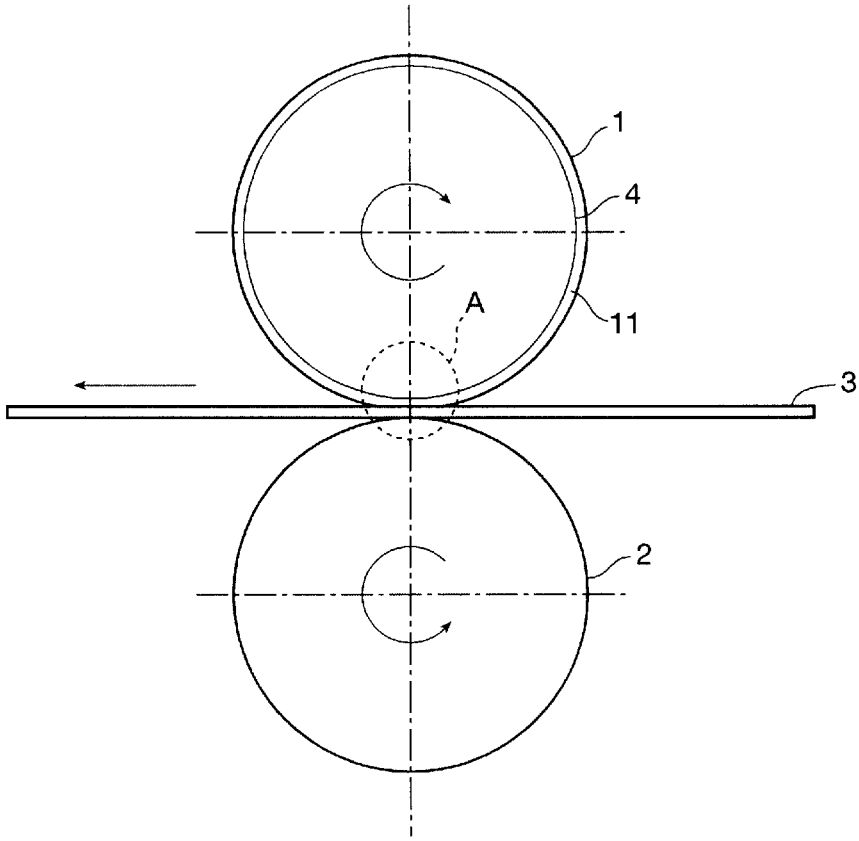
FIG. 1 shows an embodiment schematically.

FIG. 1 shows a diagram of a top and bottom conveyor body 1 and 2 in a printing, folding, and gluing machine for corrugated cardboard 3, which is also referred to in general as an in-line machine. The conveyor bodies 1, 2 are necessary for cycled advance within the machine.

The conveyor bodies 1 and 2 are mounted in a known way on driven shafts in an in-line machine. One of these conveyor bodies 1 or 2, depending on the machine design for top pressure or bottom pressure, called hereafter the scoring ring is provided on the circumference 4 with a varying number of straight sides 10, 10', 10" which are positioned end-to-end uniformly over the circumference 4, imparting a polygonal or multi-sided appearance to the scoring ring 1 as seen in plan view. These straight sides 10, 10', 10" are between 5 mm and 25 mm long, depending upon the outside diameter of the scoring ring 1.

The combined scoring and conveyor body 1 which has been provided with these straight sides 10, 10', 10" is usually made of steel or cast iron and presses the part of the corrugated cardboard 3 which is to be scored against the outer circumference of the lower conveyor body 2, which is referred to as a counter mold or anvil and has either a steel or a polyurethane working surface.

The straight sides 10, 10', 10" provided over the outside circumferential surface of the scoring ring 1 produce the desired scoring in corrugated cardboard, namely similar to that which would be achieved with a stationary strut. The difference in comparison with scoring produced by a conventional round scoring ring, consists of the fact that the invention described here creates a straight score by pressing each straight edge in turn into the corrugated cardboard 3 as the scoring ring rotates and permits satisfactory folding of finished sheets of corrugated cardboard.

The scoring ring 1 thus has a polygonal extension 11 which projects approximately 1 mm to approximately 4 mm above the circumference 4 of the annular scoring ring 1 and has a width of 0.5 mm to 4 mm, with the edges of the straight sides being rounded. The outside contour over the largest circumference 4 of the scoring ring 1 is thus that of a regular polygon with 70 corners (or sides), for example, which is not indicated in FIG. 1, because it shows the scoring ring only schematically.

Figure 2:
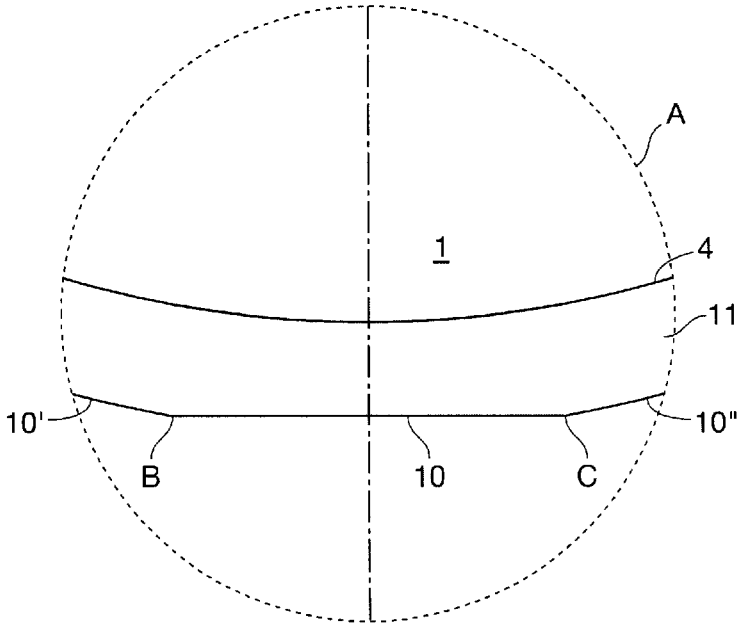
FIG. 2 shows a detail A of the scoring extension. The same parts are provided with the same reference numbers in these figures.

FIG. 2 shows an enlargement of detail A from FIG. 1, showing a better view of the straight sides 10, 10', 10." The circumference 4 of the scoring ring 1 thus extends as the arc of a circle, while the outside contour of the edge 10 which forms a single segment of the scoring extension is straight between points B and C and also to the right and left of them. This plurality of straight sides running in the plane of rotation of the scoring ring 1 thus form a polygonal scoring extension 11 which projects radially beyond the circumferential surface 4 of the scoring ring 1.

The invention has been described in terms of the preferred embodiment. One skilled in the art will recognize that it would be possible to construct the elements of the present invention from a variety of materials and to modify the placement of the components in a variety of ways. While the preferred embodiments have been described in detail and shown in the accompanying drawings, it will be evident that various further modifications are possible without departing from the scope of the invention as set forth in the following claims.

What is claimed is:

1. A scoring apparatus for accurately scoring corrugated cardboard to produce fold lines for facilitating folding the cardboard into a box of predetermined dimensions, the scoring apparatus comprising:

an annular scoring ring having a circumferential surface provided with a plurality of straight sides radially extending away from said circumferential surface of said scoring ring and aligned end to end in a plane of rotation of said scoring ring to form a polygonal scoring extension, said scoring ring mounted on a shaft for rotation;

an annular conveyor ring having a circumferential surface mounted on a shaft for rotation in a direction opposite to that of said scoring ring; and, a conventional drive for rotating said shafts;

said scoring ring and said conveyor ring mounted adjacent to each other to form a nip for conveying and scoring said cardboard, said polygonal scoring extension of said scoring ring and said circumferential surface of said conveyor ring being spaced apart from each other by a predetermined distance which is determined by the kind of corrugated board being scored, whereby when said cardboard is drawn between said scoring ring and said conveyor ring as said scoring ring and said conveyor ring rotate, each raised straight edge of said polygonal scoring extension, in turn, presses said cardboard against said circumferential surface of said conveyor ring, creating a substantially straight fold line in said cardboard from a leading edge of said cardboard to a trailing edge of said cardboard.

2. The scoring apparatus of claim 1 wherein said straight sides are between about 1 mm and about 25 mm in length.

3. The scoring apparatus of claim 1 wherein said scoring ring is made from a durable, substantially rigid material.

4. The scoring apparatus of claim 1 wherein said scoring ring is constructed from a material selected from the group consisting of steel and cast iron.

5. The scoring apparatus of claim 1 wherein said conveyor ring has a circumferential surface formed from steel.

6. The scoring apparatus of claim 1 wherein said conveyor ring has a circumferential working surface formed from polyurethane.

7. The scoring apparatus of claim 2 wherein said straight sides extend radially from about 1 mm to about 4 mm beyond said circumferential surface of said scoring ring.

8. The scoring apparatus of claim 7 wherein said straight sides have a width of about 0.5 mm to about 4.0 mm.

9. The scoring apparatus of claim 8 wherein each of said straight sides have a distal surface, which contacts and scores said cardboard, which is rounded.

10. A scoring ring for scoring cardboard, said scoring ring being mountable in a conventional scoring apparatus for accurately scoring corrugated cardboard to produce fold lines for facilitating folding the cardboard into a box of predetermined dimensions, the scoring apparatus including a rotatable shaft for rotating an annular scoring ring having a raised scoring extension, an annular conveyor ring having a circumferential surface mounted on a shaft for rotation in a direction opposite to that of said scoring ring and a conventional drive for rotating the shafts; the scoring extension and the circumferential surface of the conveyor ring mounted adjacent to each other and spaced apart by a predetermined distance to form a nip for conveying and scoring the cardboard, said predetermined distance determined by the kind of corrugated cardboard being scored, said scoring ring comprising:

a ring mountable on a shaft for rotation, said ring having a circumferential surface provided with a plurality of raised straight sides aligned end to end to form a polygonal scoring extension, whereby when said corrugated cardboard is drawn between said polygonal scoring extension and said conveyor ring as said scoring ring and said conveyor ring rotate, each raised straight side of said polygonal scoring extension, in turn, presses said cardboard against said circumferential surface of said conveyor ring, creating a substantially straight fold line in said cardboard from a leading edge of said cardboard to a trailing edge of said cardboard.

11. The scoring ring of claim 10 wherein said straight sides are between about 5 mm and about 25 mm in length.

12. The scoring ring of claim 10 wherein said scoring ring is made from a durable, substantially rigid material.

13. The scoring ring of claim 12 wherein said durable, substantially rigid material is selected from the group consisting of steel and cast iron.

14. The scoring ring of claim 11 wherein said straight sides extend radially from about 1 mm to about 4 mm beyond said circumferential surface of said ring.

15. The scoring ring of claim 14 wherein said straight sides have a width of about 0.5 mm to about 4.0 mm.

16. The scoring ring of claim 10 wherein each of said straight sides have a rounded edges.

17. A method of scoring corrugated cardboard to produce fold lines for facilitating folding the cardboard into a box of predetermined dimensions, using a scoring apparatus having an annular scoring ring having a circumferential surface provided with a plurality of straight sides radially extending away from said circumferential surface of said scoring ring and aligned end to end in a plane of rotation of said scoring ring to form a polygonal scoring extension, said scoring ring mounted on a shaft for rotation, an annular conveyor ring having a circumferential surface mounted on a shaft for rotation in a direction opposite to that of said scoring ring, and a conventional drive for rotating said shafts, and wherein the scoring ring and the conveyor ring are mounted adjacent to each other to form a nip for conveying and scoring said cardboard, the polygonal scoring extension of the scoring ring and the circumferential surface of the conveyor ring being spaced apart from each other by a predetermined distance which is determined by the kind of corrugated board being scored, the method comprising the steps of:

adjusting the spacing between the polygonal scoring extension and the circumferential surface of the conveyor ring to exert a predetermined pressure on corrugated board to be scored;

activating the drive for rotating the scoring ring and the conveyor ring;

conveying corrugated board to a nip formed between the polygonal scoring extension and the circumferential surface of the conveyor ring;

feeding a leading edge of the corrugated board into said nip;

continue rotating said scoring ring and conveyor ring to convey and score the corrugated board from said leading edge to a trailing edge of the corrugated board as each side of the polygonal scoring extension in turn presses the corrugated board against the circumferential surface of the conveyor ring and moves the corrugated board in a downstream direction; and, conveying the scored corrugated board in a downstream direction away from scoring ring and conveyor ring.

* * * * *